United States Patent [19]

Yamazaki

[11] 4,057,971

[45] Nov. 15, 1977

[54] BRUSH-TYPE PACKING MEANS FOR SHIELD EXCAVATOR

[75] Inventor: Hironobu Yamazaki, Kashiwa, Japan

[73] Assignee: Tekken Kensetu Co. Ltd., Japan

[21] Appl. No.: 689,724

[22] Filed: May 25, 1976

[30] Foreign Application Priority Data

Mar. 4, 1976 Japan ..... 51-22612

[51] Int. Cl.[2] ..... E01G 5/16

[52] U.S. Cl. ..... 61/84; 61/42

[58] Field of Search ..... 61/85, 84, 42, 45 R, 61/63; 49/475; 299/31–33

[56] References Cited

U.S. PATENT DOCUMENTS

| | | | |
|---|---|---|---|
| 646,354 | 3/1900 | Buel | 61/85 |
| 723,986 | 3/1903 | Carson | 61/85 |
| 3,410,098 | 11/1968 | Winberg | 61/85 |
| 3,979,920 | 9/1976 | Burgess et al. | 61/85 |

FOREIGN PATENT DOCUMENTS

| | | | |
|---|---|---|---|
| 1,529,828 | 5/1968 | France | 61/85 |
| 1,197,914 | 8/1965 | Germany | 61/85 |

*Primary Examiner*—Dennis L. Taylor

*Attorney, Agent, or Firm*—Pierce, Scheffler & Parker

[57] ABSTRACT

A brush-type packing means for shield tunnel excavators which is high in wear resistance and shielding effect against underground water is provided. The packing means comprises at least two rows of resilient wire brushes secured substantially in parallel ring shape along inner periphery of substantially cylindrical excavator body adjacent its tail end or peripheral edge of tunnel entrance on wall surface of vertical shaft as spaced in tunnelling direction to close a gap space between the tail end or the entrance edge and peripheral surface of tunnel wall element inserted in excavated tunnel, and the space between the respective rows of the wire brushes is sealed with a material which is viscous and impermeable to water.

8 Claims, 4 Drawing Figures

BRUSH-TYPE PACKING MEANS FOR SHIELD EXCAVATOR

This invention relates to brush-type packing means for shield tunnel excavators.

So many sewerage and underground railway constructing works are being carried out today in and around cities that so-called shield type tunnel excavations are employed extensively. However, in most of them, such packing means employed at tunnel entrance and tail end of the excavator as will be later described is incomplete so that so-called back filling of cement mortar or the like into a space made in the ground around tunnel wall elements is difficult to perfectly carry out, whereby ground collapse will be readily induced and serious accidents will be likely to be caused in and around cities under which various pipes are embedded many in every direction.

References shall be made more specifically to the packing to which the present invention relates with reference to FIG. 1 showing schematically an example of simple and short distance tunnel excavating work, in which a vertical shaft 1 is first dug vertically to the ground surface and, when a desired depth is reached, a tunnel is horizontally made employing, in the case shown in FIG. 1, a cylindrical metal head 2 for excavation at the forward end and concrete Hume pipes 2' of a smaller diameter and sequentially following the metal head 2 as butted endwise to each other, which are horizontally pressed upon at the rear end surface by a press ring means 3 driven by jacks 3' while removing the soil or the like out of the Hume pipes 2' to the ground surface. In this case, as there is a difference between respective outer diameters of the head 2 and Hume pipes 2' so that the first Hume pipe butted to the head 2 will engage at an end to an inward projection fixed to the inner periphery of the head 2 adjacent its tail end, a gap space corresponding to this diameter difference is caused to be produced as the tunnel excavation advances and a cement mortar layer 6 is formed in the gap space by injecting a cement mortar into the space through holes provided in the body of the Hume pipes for preventing any collapse of ground layer at such space. This gap space is of course made at the initial entrance point of the tunnel excavation on a side wall 4 of the vertical shaft 1 and, in order to prevent any flow out of the soil or the like as well as under ground water at the initial stage and of the cement mortar at a later stage through the space, a packing means 5 is provided to shield the gap space between the edge part of the side wall 4 of the vertical shaft 1 and the outer periphery of the Hume pipes 2'. It will be readily understood that even in the case when an excavator having a rotary cutter head is used at the tunnel face, instead of the cylindrical head 2, for cutting the ground layer by the cutter head and conveying the excavated soil or the like onto the ground surface and the periphery of the excavated tunnel is reinforced by concrete or the like segments, such packing means will be required to shield the gap space.

As the above described packing means, a plate-shaped packing of such material as a natural rubber, urethane rubber or synthetic rubber has been conventionally used. However, this kind of rubber material is so high in the wear that the packing must be replaced quite often and, due to such shape of the resilient packing, it is difficult to maintain an intimate engagement of the respective packing plates with the outer periphery of the Hume pipe or tunnel wall segment to achieve a complete packing, and stones or the like objects may be readily jammed between the packing and the pipe or segment so that the back filling material, flowing sand, mud water or the like will leak through the packing, whereby, not only the working efficiency will be remarkably reduced, but also the ground layer collapse will be readily caused to occur.

The above has been referred to the case of so-called entrance packing employed between the tunnel entrance edge at the vertical shaft and the outer periphery of the excavator body of various types or of the Hume pipe or tunnel wall segment, but the same problems as disclosed above commonly apply to the case of so-called tail packing employed in the similar manner between the inner periphery of the excavator at its tail end and the outer periphery of the pipe or segment butted to the excavator.

In order to improve the packing means in respect of such defects as described above of the plate-shape packing of rubber or the like resilient material, there have been suggested certain brush-type packings employing rigid but resilient wire brushes of such wire material as nylon string, hard steel wire, piano wire, stainless steel wire or the like so that the packing will be higher in wear resistance and also in sealing or packing efficiency as compared with the plate-shaped rubber packing. In FIG. 2, there is shown an example of such known brush-type packing means, in which case the means is shown as the tail-packing so that any gap clearance between the inner periphery of the excavator body and the Hume pipe or tunnel wall segment will be closed by the brush wires to prevent any soil or the like and under ground water as well from leaking into the tunnel through the joint part of these members. In the drawing, many flat bunched type packing wire brushes 13 having a resiliency and wear resistance are placed on the entire inside periphery of a tail skin plate 12 of a cylindrical excavator body 11 and held adjacent one end of the respective brushes by means of a holding plate 14 fixed to the skin plate 12 by bolts 15. A channel member 16 holds tightly the end of each bunched wire brush packing 13. The other free end of each brush packing 13 is oriented inward so that it will be resiliently bowed as shown with a chain line to engage the peripheral surface of a Hume pipe or wall-segment shown by a straight chain line 17 to close the clearance. According to this arrangement, the respective wires of the brush packing 13 will evenly contact the periphery of the pipe or segment 17 achieving a presention of the leakage of the soil or the like and, even in the case of a water containing ground layer, the brush wires will cause the capillary phenomenon of water to occur therebetween so as to prevent substantially thereby any water leakage. While this type of brush packing is advantageous in achieving an even and intimate engagement with the pipe or segment periphery in addition to the higher durability, however, the brush bunch must be thick and dense to prevent water leakage so as to be utilizable even in the case of a ground of much higher water content but, when relatively large stone material or the like remains jammed between the brush wires, the respective wires tend to be thereby separated from each other to cause a clearance around such stone material or the like allowing water to leak therethrough.

In order to improve the brush-type packing in the above respect, there is suggested another brush-type packing means as shown in FIG. 3, in which case a fitting plate 23 is annularly secured by welding or any other means to the inside surface of a skin plate 22 of a body 21 of the shield excavator, a plurality of brush type packings 24 of metal wires which are respectively crimped and bent in the middle of their length around a core wire 25 are bundled by means of typing wire 26 and secured along the plate 23 with pressing plates 28 respectively having a recess 27 and bolts 29. In this example, the metal wires 24 are crimped or waved so as to be entangled with each other to produce a netshaped action providing an increased packing effect. However, this brush-type packing means with the crimped wires is still incomplete when the means encounters a ground of a very high water content accompanying high water pressure, or specifically when a relatively large stone or the like object is caused to be held by the brush, in which cases water leakage prevention cannot be made to reply upon the capillary phenomenon and brush wires entangled with each other still tend to produce a clearance around the stone or the like object.

The present invention has been suggested to remove successfully such defects in the conventional packing means as described in the foregoing, by providing a brush-type packing means employing wires highly resilient and wear resistive arranged in two rows spaced in the longitudinal direction of the tunnel being excavated and the space between these two rows of the brush wires is substantially filled with a viscous material and which is impermeable to water.

A primary object of the present invention is, therefore, to provide a brush-type packing means for a shield tunnelling excavator which is high in resiliency and still very durable and achieves a higher packing efficiency.

A related object of the present invention is to provide a brush-type packing means for a shield tunnelling excavator which ennables tunnel excavation with a high safety preventing any collapse in the ground layer and thus with a higher efficiency.

Other objects and advantages of the present invention will be made clear by reference to the following disclosure of the present invention detailed with reference to a certain preferred embodiment as illustrated in the accompanying drawings, in which.

Figure 1:
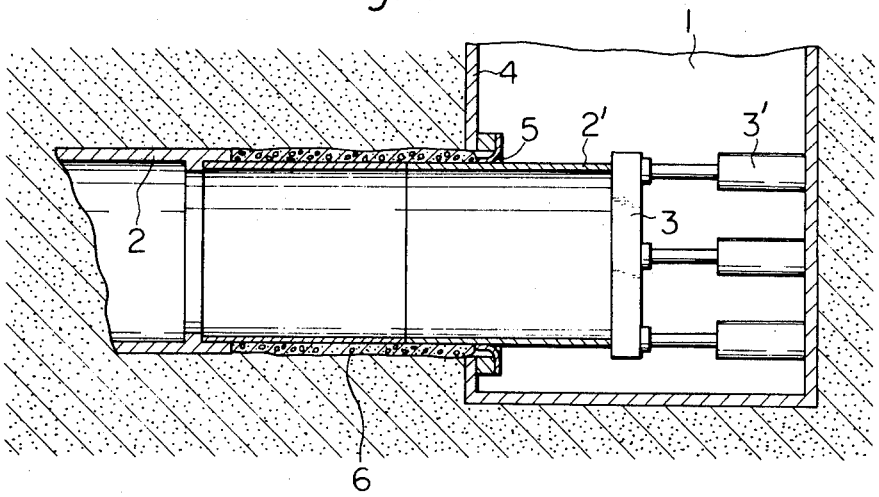
FIG. 1 is a schematic view showing an example of usage of a union packing means for a simple tunnel excavation.
Figure 2:
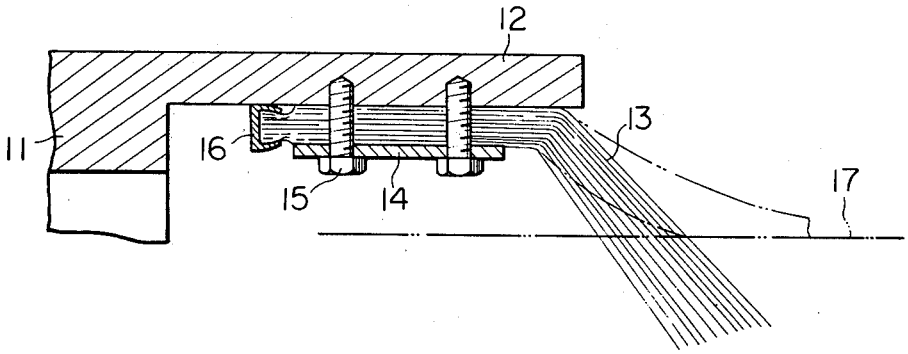
FIGS. 2 and 3 are fragmentary enlarged sectioned views of other conventional packing means in other usage.
Figure 3:
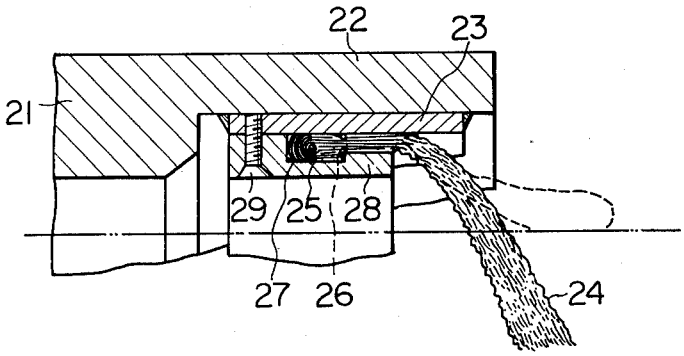
Figure 4:
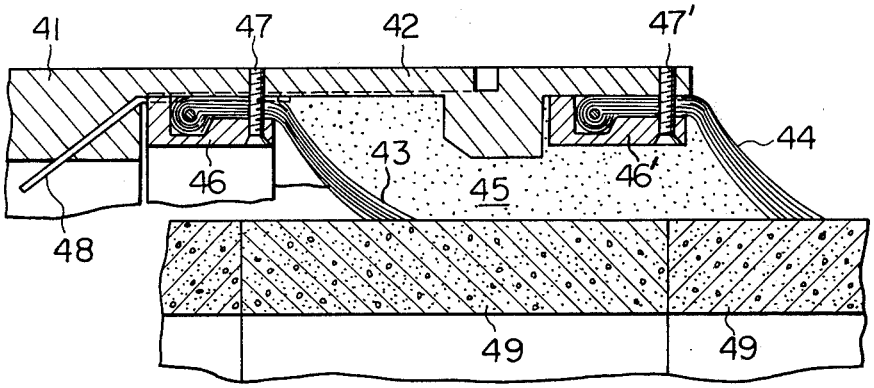
FIG. 4 is a similar sectioned view showing an embodiment of the present invention in the case of the same usage as in FIGS. 2 and 3.

Referring to FIG. 4 showing a preferred embodiment of the present invention, inside a skin plate 42 of a cylindrical body 41 of the shield excavator, ring-shaped brushes 43 and 44 made of substantially the same metal wires as are described above are fixed in two rows with bolts 47 and 47' by means of pressing metal fixtures 46 and 46', respectively, at a desired spacing in the longitudinal direction of the body 41. A pipe 48 is interposed preferably between the pressing metal fixture 46 and the skin plate 42 and viscous fluid material 45 which permeates into but does not pass through the brush packing as, for example, a grease is poured into the space between both ring-shaped brushes 43 and 44 and the tunnel wall segments 49 through said pipe 48 until the space is filled with the material so as to seal the brushes 43 and 44 in a liquid-tight manner.

In this embodiment, since the gap between the excavator and the segments is liquid-tightly sealed between the two rows of the brush packings, water can be perfectly prevented from entering the excavator and, as the viscous fluid material has a wear resistance, the damage and wear of the brushes can be prevented.

While the present invention has been described mainly with reference to the entrance packing at the tunnel entrance in the vertical shaft and the tail packing between the excavator and tunnel wall elements, the packing means can be similarly used around the rotary cutter head in a shield slurry type of tunnelling excavator as provided preferably at the head end side of the cylindrical excavator body.

It will be also appreciated that the metal wires to be used in the present invention may not be limited to straight wires but crimped metal wires may be also employed.

It should be further appreciated that, while the brush wires are mainly shown as secured flat and bent inward and in order to achieve this arrangement the wire materials will be required normally to be preliminarily bent before being secured, an angled securing means instead of the flat pressing plate as shown may be employed for securing straight wires and simultaneously orienting the wires inward.

What is claimed is:

1. A brush-type packing means for a shield tunnel excavator comprising at least two rows of substantially ring-shaped wire brushes respectively made of wires bunched and having a high resiliency and wear resistance and spaced in the longitudinal direction of said excavator providing substantially an annular space therebetween each said ring-shaped brush being secured along the inner periphery of a substantially cylindrical excavator body adjacent the tail end thereof and projected inward at its free end, means for securing said brushes to a position for closing a gap between tunnelled ground surface and peripheral surface of a tunnel wall element inserted in excavated tunnel, and a viscous sealing material impermeable to water and substantially filled in said annular space, said sealing material having a fluidity suitable for permeating into clearances between respective wires of said brush but not passing through the brush.

2. The packing means according to claim 1 wherein said sealing material is a grease.

3. The packing means according to claim 1 wherein said ring-shaped brushes are secured along peripheral edge of an entrance hole of said tunnel at a wall surface of a vertical shaft from which the tunnel is excavated.

4. The packing means according to claim 1 wherein said wires are respectively crimped and entangled with each other.

5. The packing means according to claim 1 wherein said bunched wires are made from hard steel.

6. The packing means according to claim 1 wherein said bunched wires are made from stainless steel.

7. The packing means according to claim 1 wherein said bunches wires are made from piano wire.

8. The packing means according to claim 1 wherein said bunched wires are made from a synthetic resin.

* * * * *